United States Patent [19]

Davidson

[11] 4,036,388

[45] July 19, 1977

[54] SEALING GASKETS FOR CONTAINER CLOSURES

[75] Inventor: James John Alexander Davidson, St. Neots, England

[73] Assignee: W. R. Grace & Co., Cambridge, Mass.

[21] Appl. No.: 716,901

[22] Filed: Aug. 23, 1976

Related U.S. Application Data

[62] Division of Ser. No. 580,199, May 23, 1975, abandoned.

[30] Foreign Application Priority Data

May 28, 1974 United Kingdom ..... 23611/74

[51] Int. Cl.[2] ..... B65D 53/00; B65D 53/04

[52] U.S. Cl. ..... 215/341; 215/343; 53/16; 220/289

[58] Field of Search ..... 215/341, 343, 345, 352; 220/289, 304, 222, 378; 53/15, 16, 17, 18, 41, 42; 113/80 D, 80 DA, 80 BA

[56] References Cited

U.S. PATENT DOCUMENTS

| | | | |
|---|---|---|---|
| 3,344,093 | 9/1967 | Strickman | 113/80 DA X |
| 3,828,963 | 8/1974 | Moller | 215/341 X |
| 3,868,038 | 2/1975 | Hadley | 215/341 X |
| 3,883,025 | 5/1975 | Jemmett | 215/341 |

*Primary Examiner*—Othell M. Simpson
*Assistant Examiner*—Horace M. Culver
*Attorney, Agent, or Firm*—Armand McMillan; Edward J. Hanson, Jr.; C. E. Parker

[57] ABSTRACT

The invention relates to the gasketting of cap blanks, to be closed onto bottles or other containers.

The gaskets lie across the more or less flat top of the cap blank and the invention is concerned with the peripheral part of the gasket, i.e. that part which occupies the corner of the cap between the flat top and the skirt.

One kind of closing operation in which a gasketted cap blank is closed onto a bottle neck involves so-called "reform", i.e. a lateral pinching action at the top of the skirt. To aid closing the bottle cap symmetrically on the bottle, the peripheral part of the gasket includes a relatively flat step portion.

3 Claims, 6 Drawing Figures

SEALING GASKETS FOR CONTAINER CLOSURES

Figure 1:
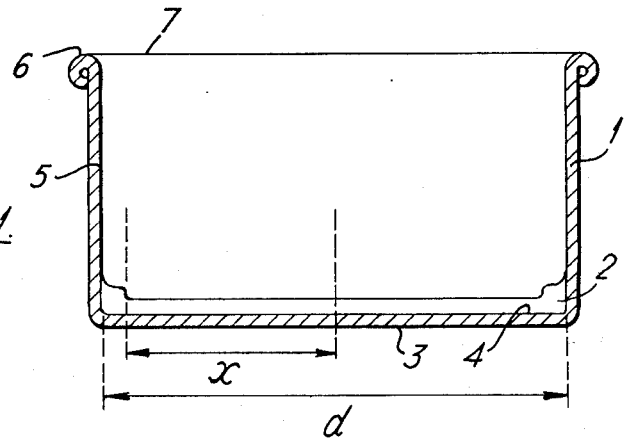

This is a division of application Ser. No. 580,199 filed May 23, 1975 and now abandoned.

This invention relates to sealing gaskets for container closures, in particular to the configuration (profile) of gaskets for threaded closures.

Container closures are provided with gaskets primarily in order to prevent air from entering the container and/or loss of contents of the container to the outside. They are especially important in closures for containers which hold food or drink since contamination of the food or drink within a container by the entry of air before consumption can be a serious health hazard. A major area of use of gasketted closures is for the closing of bottles.

In order to enable a customer to re-close the container after it has been opened it is desirable to provide a threaded closure which can be removed by unscrewing. One general type of threaded closure which has found widespread commercial acceptance is the in situ-threaded type; threads are formed during or after the operation of closing the closure onto the container. Generally, a closure which is initially unthreaded is closed by pressure onto the neck of a threaded container. Further, lateral, pressure is then applied to impart threads to the closure while it is on the container, the threads formed in the closure corresponding to those on the neck of the container. For example the threads may be formed with the aid of a roller. Closure caps having threads formed in this way are termed "roll-on" caps and are usually used on bottles.

Gaskets for closures of the above type have hitherto been produced by the so-called spin-line process. In the spin-line process a pre-determined quantity of a plastisol of polyvinyl chloride is entered into a closure, the closure is spun rapidly about an axis through the centre of the flat top of the closure so as to distribute the plastisol by the action of centrifugal force, and the plastisol in the closure is then fluxed. The plastisol is a viscous dispersion of polyvinyl chloride in a plasticiser. It is fluxed by heating it to a temperature at which the plasticiser is absorbed by the polyvinyl chloride to form a homogeneous mass, which upon cooling gives a rubbery solid.

The spin-line process, although commercially successful, has limitations. One limitation is that the profile of gasket cannot be satisfactorily varied. It is desirable to be able to vary the profile of a gasket according to the particular size of cap and dimensions of bottle employed. Because in the spin-line process the shaping is effected by centrifugal force the gaskets produced will inevitably gradually increase in thickness from the centre of the closure to its periphery. Thus, if for a particular closure one wants to increase the thickness of the gasket near the periphery, it is necessary to increase the total charge of plastisol metered into the closure or to increase the centrifugal force applied. The former is disadvantageous because it results in a gasket which is also thicker near the centre of the closure; this extra thickness at the centre is not required and thus there is a waste of the valuable plastisol. The latter is disadvantageous because of the whole profile of the gasket is changed and plastisol may be thrown a considerable distance away from the top of the closure along the skirt, a position where it is not required. Thus the relatively "fixed" profile of the gaskets produced by the spin-line process is disadvantageous because of the difficulty or lack of economy in making minor variations to the profile.

A second problem of the spun-line gaskets is that for at least certain closures of the above-described type a relatively large amount of gasket is required to give an effective sealing performance.

Another problem of the spin-line process is that in large production runs it is difficult to introduce the gasket-forming plastisol symmetrically into the region of the centre of the closure, with the result that when the closure is spun the sealing portion is not formed consistently in the shape desired.

Yet another problem is that the choice of materials used for the gasket is limited to those which can be formulated as a viscous liquid for spinning, such as a polyvinyl chloride plastisol.

In our British Patent Application No. 17646/73, we have proposed certain gaskets of different profile from those produced by the spin-line process. These gaskets are useful in the in situ threaded container closures in general, and may be made by moulding. Considered in their undeformed configuration, i.e. before the closure is closed onto the container, these gaskets comprise a substantially flat central panel and an adjoining peripheral portion, the thickness of which is at all points greater than the thickness of the central panel and increases continuously and/or stepwise radially outwards to the skirt of the closure.

To express this profile in another way, consider the closure in its inverted or up-turned position, meaning the opposite way to which it is seen when closed onto a bottle. The peripheral portion of the gaskets of British Patent Application 17646/73 extends to a point on the skirt of the closure which is overall upwards from the central panel of the gasket. Considered in the direction of increasing radius from the centre of the closure (the radially outward direction), the height of the peripheral portion above the central panel starts by increasing and thereafter either continues to increase or remains the same.

The gaskets of British Patent Application No. 17646/73 having the above-defined profile enable the above-described problems to be overcome, at least to a considerable extent. They do not require such large amount of gasket material. Since they are made by moulding, their profile can be varied, it is easy to introduce the gasket-forming material into and form it centrally in the closure and a wide variety of different materials may be employed.

The present invention is concerned specifically with gaskets for in situ threaded caps, especially roll-on caps, which are to be closed onto the container by a "reform" operation. In this operation force is exerted during the closing of the cap not only downwardly but also laterally of the skirt of the cap, so as to pinch the top of the skirt inwards. In other words, the diameter of the skirt of the cap is reduced so as to compress the gasket between the top of the skirt of the cap and the side of the neck of the container. A "reform" operation of this type is described in British Patent Specification No. 975,739.

Among the general class of gasket profiles described in British Patent Application 17646/73, certain profiles are described as giving a good sealing performance when the cap is subjected to a reform operation. We have now found certain other profiles within this general class which not only give a good sealing performance in this operation, but possess another advantage not enjoyed by the general class or by the profiles specifically disclosed for use in the reform operation.

The present invention provides a gasketted container cap blank for closing onto a container by a reform operation and to be threaded in situ on the container, characterised in that the gasket in the cap blank possesses a flat central panel occupying from 50 to 94% of the internal radius of the cap blank and an adjoining peripheral portion occupying the remaining 6 to 50% of the radius, the configuration of the peripheral portion being as follows, namely: considering the cap blank in an upturned position relative to that which it occupies on the container and considering the peripheral portion in a radially outward direction, it comprises consecutively:

i. a first part (AB) of relatively steep gradient upwards from the edge of the central panel which makes an angle ($\beta$) with the plane of the central panel of from 25° to 90° and which has a radial length from 5 to 30% of the radial length (AW) of the whole peripheral portion (AE);

ii. an adjoining relatively flat step part (BC) of constant gradient which makes an angle ($\alpha$) with the plane of the central panel from 0 to 25° and which has a radial length of from 10 to 70% of the radial length (AW) of the whole peripheral portion (AE);

iii. an adjoining corner part (CD) sloping upwardly, the height (DX) of which above the plane of the step part is from 20 to 65% of the height (DY) of the top of the corner part above the plane of the central panel; and iv. an adjoining final marginal part (DE) which extends to the skirt either as flat step or upwardly and which has a radial length of from 2 to 15% of the radial length (AW) of the whole peripheral portion (AE).

Generally the peripheral portion of the gasket will occupy only a small area of the total surface of the flat top of the cap. The area occupied is conveniently defined in terms of the distance *d*, the maximum internal diameter of the cap and *x*, the radial length of the flat central panel (measured from the centre of the cap to its edge where it adjoins the peripheral portion). The distance *x* may be from 25 to 47% of *d*, but will not usually exceed 45% or be less than 35%.

We have found that the gasketted cap blanks of the invention are much easier to close onto the container by the method described above than many of those described in British Patent Application 17646/73. The latter caps often become cocked out of their correct alignment when the closing head is brought to bear on them, with the result that the cap is not closed at all or is closed in an off-centre manner. An off-centre cap will often fail to give a good enough seal. In the gaskets of the invention this disadvantage can be at least mitigated.

We believe that the main feature of the gaskets of the invention responsible for the improved performance in the closing operation is the provision and location of the step portion (ii). It appears that step portion (ii) bears against the rim of the neck of the bottle in such a way as to reduce the chance of cocking during the closing operation. Thus the step portion (ii) should be so located that at least a part of it, and preferably at least half thereof measured along the radius bears against at least part of the flat area of the rim of the neck of the bottle. In general its radial length will be from about 10 to 70%, the optimum radial length depending inter alia upon the configuration of other parts of the peripheral portion, as described hereinafter.

Since the gaskets are ordinarily made by moulding gasket material (within the cap blank), the problems associated with the spin-line process are avoided.

Figure 2:
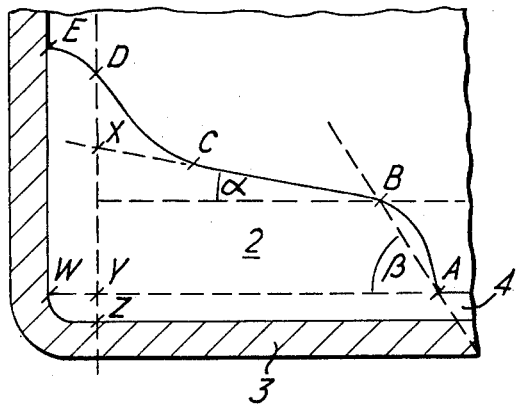
Figure 3:
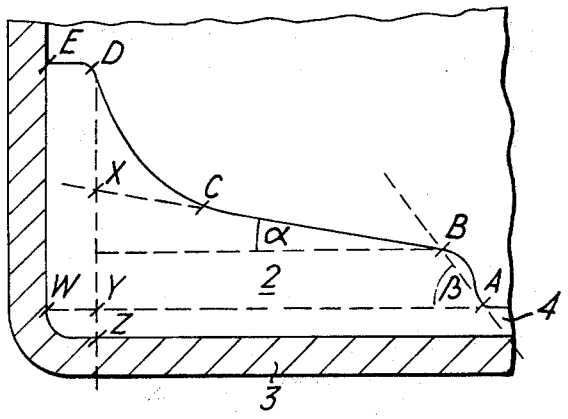
Figure 4:
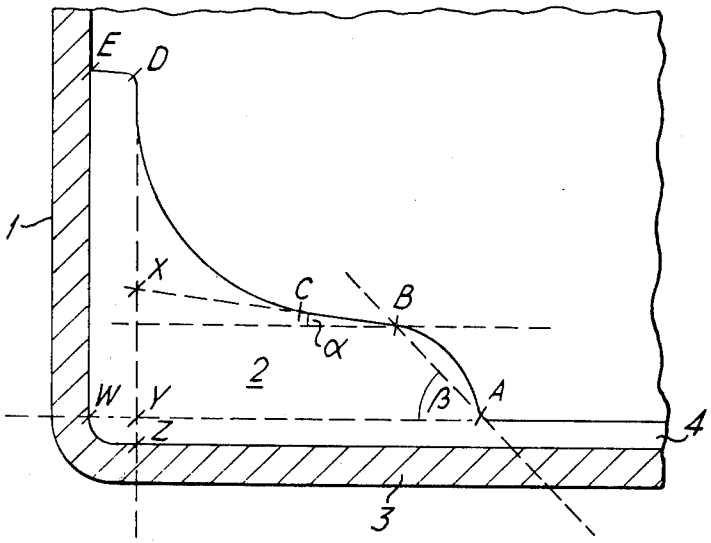
Figure 5:
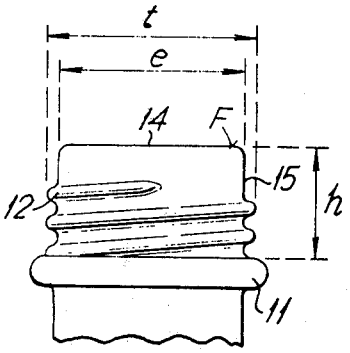
Figure 6:
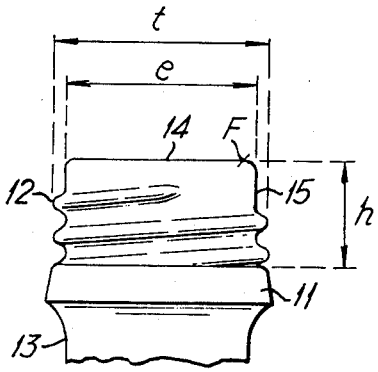

Preferred embodiments of the invention will now be described in more detail with reference to the accompanying drawings, in which: FIG. 1 is a sectional view of a gasketted cap blank of the invention taken through a diameter, the cap being in an up-turned position relative to its position on a container; FIGS. 2, 3 and 4 are enlarged views of part of gasketted cap blanks according to the invention showing the configuration of the peripheral portion of the gasket — they are sectional views taken through part of a radius; and FIGS. 5 and 6 are side views of the top portions of bottle necks onto which gasketted cap blanks of the invention may be closed.

Referring to FIG. 1, the cap blank 1 shown has not yet been closed onto a container. It is made of thin aluminum, typically 0.008 to 0.012 inch (200 to 300 microns) thick, and will normally be lacquered on the inside and outside. (However, the presence of a lacquer or its nature is not critical to the present invention). It has a flat top 3 from which depends a skirt 5 bent over at its other end into a bead 6 defining a mouth 7. The gasket, having a configuration in accordance with the present invention, consists of a peripheral portion 2 beginning at a radial distance *x* from the centre of the flat top 3 of the cap blank and adjoining a central panel 4. The distance *d* marked is the maximum internal diameter of the cap blank. For a cap blank having an external diameter of 28 mm., *d* is 1.092 inch (27.7 mm.). The diameter of the cap blank is not critical and the invention is applicable to cap blanks having a variety of different diameters, including the commonly employed bottle cap blanks of external diameters 26, 28 and 31.5 mm.

Some cap blanks have a knurled band stamped therein just above the level of the gasket. A main purpose of this band is to stop the gasketting material from being flung too far along the skirt in the spin-line process. This band is not needed in the present invention and so is now shown in FIG. 1, but it could of course be provided if desired.

FIGS. 2 and 3 show the peripheral portions 2 of two gaskets in accordance with a first embodiment of the invention. These Figures have been labelled geometrically to show distances and angles. We refer first to the geometric labelling of FIGS. 2 and 3 to explain the invention generally. The peripheral portion 2 of the gasket has an upper surface defined by the line ABCDE. The first part AB has a relatively steep gradient upwards from the edge A where the peripheral group 2 joins the central panel 4. It may have a planar or convex slope, preferably convex for ease of moulding. The angle $\beta$ is between 25° and 90°. The radial length of the portion AB is from 5 to 30%, more usually 5 to 20%, of the radial length AW of the whole peripheral portion AE. In principle the radial distance AB could be greater, thereby producing a less steep gradient for any given height of B above the central panel, but since part of the aim of the invention is to take advantage of every reasonable economy which can be made in gasket material without adversely affecting the quality of the seal, a length of more than 30% on the above basis is of little practical interest. Because of the gasket can be moulded it is possible to make the gradient AB fairly steep and thereby economise on gasket material.

The second step portion BC may be flat or have a slight upward slope so that the angle $\alpha$ may be from 0° to 25° usually 0° to 15° and preferably 5°–10°. The radial length of the step portion BC will generally be from 30 to 70, preferably 40 to 60 percent of AW. The optimum height XY of the step portion above the level of the central panel 4 will depend on the resilience and toughness of the gasket material employed and may also depend on the nature of the neck of the bottle. This will be discussed further with reference to FIGS. 5 and 6.

The "corner part" CD will normally have a concave slope when viewed as in FIGS. 2 and 3, but a planar or slightly convex slope might be appropriate for some purposes. The height of CD will vary according to precisely how much gasket material it is desirable to have pressed into the corner of the cap when the cap blank is closed onto the bottle. In general the distance DX will be from 20 to 65% of the total height DY of point D above the central panel.

The distance of the point D radially from the centre of the cap corresponds to the radius of the moulding member employed to mould the gaskets. Thus the remainder of the peripheral portion, represented by DE is the radial tolerance of the moulding operation. The dimensions of the portion DE therefore have no great significance in themselves but DE will generally slope upwards e.g. as in FIG. 2 or be flat as in FIG. 3. The radial length of DE many constitute between 2 and 15% of the radial length AW of the whole peripheral portion. If the portions CD and DE both slope upwards so that it is impossible to discern a point D, the radial length DE may be assumed to be the tolerance of the moulding member within the cap.

All the corners at points A, B and C are preferably rounded slightly, for ease of moulding, but in principle they could be sharply defined.

Table 1 gives the dimensions applicable to some particular gasketted cap blanks in accordance with FIGS. 2 and 3:

TABLE 1

| | FIG. 2 | | FIG. 3 | |
|---|---|---|---|---|
| | inches | (mm.) | inches | (mm.) |
| External diameter of closure | 1.102 | (28.000) | 1.102 | (28.000) |
| Internal diameter of closure d | 1.092 | (27.737) | 1.092 | (27.737) |
| Distance x | 0.425 | (10.795) | 0.400 | (10.160) |
| Ratio x/d | 0.39 | | 0.37 | |
| Radial lengths | | | | |
| of AB | 0.0223 | (0.566) | 0.0203 | (0.516) |
| of BC | 0.0521 | (1.323) | 0.0791 | (2.009) |
| of CD | 0.0331 | (0.841) | 0.0331 | (0.841) |
| of DE | 0.0135 | (0.343) | 0.0135 | (0.343) |
| of AE (=AW) | 0.121 | (3.073) | 0.1460 | (3.708) |
| Heights | | | | |
| YZ (central panel) | 0.006 | (0.152) | 0.006 | (0.152) |
| XY | 0.0416 | (1.057) | 0.0341 | (0.800) |
| DX | 0.0336 | (0.853) | 0.0336 | (0.853) |
| Radii of curvature | | | | |
| At A (concave) | None | | 0.10 | (2.54) |
| At B (convex) | 0.27* | (6.86) | 0.015* | (0.38) |
| Of CD (concave) | 0.040 | (1.016) | 0.040 | (1.076) |
| Angles | (degrees) | | | |
| $\alpha$ | 10 | | 10 | |
| $\beta$ | 50 | | 36 | |
| Gasket material: | Mixture of equal parts by weight of polyethylene and butyl rubber | | | |

*The whole portion AB (except for the concave radius at A in FIG. 3) has a convex slope of this radius of curvature.

In principle, any gasketting material may be employed in the present invention. A preferred material in a mixture comprising polyethylene, butyl rubber, and optionally a ethylene/vinyl acetate copolymer. Polyethylene/butyl rubber mixtures containing e.g. 40–70% by weight of polyethylene and 60–30% by weight of butyl rubber are generally suitable. Gaskets are preferably formed from these mixtures by cold-moulding as described e.g. in our British Patent Specification No. 1,112,023, Australian Patent Specification No. 420,653 and German Auslegeschrift 1,544,989. Other usable gasketting materials include plasticised polyvinyl chloride and other vinyl chloride polymers known in the gasket-making art, other materials described in our British Patent Specification Nos. 1,112,024 and 1,112,025 and thermoplastic copolymers of butadiene with styrene, optionally in admixture with other materials such as polyethylene. This class of materials is described in our British Patent Specifications Nos. 1,196,125 and 1,196,127. The gasketting material is conveniently, but need not be, introduced into the cap in the form of a solid. It may be a plastisol of a vinyl chloride polymer. Such a plastisol can be moulded by the process described in our British Patent Specification No. 1,239,927.

The gasketting materials may of course contain any of the usual additives such as a stabilser, platiciser, pigment, dye, filler, slip agent or lubricant.

Although, as explained above, a wide choice of gasketting materials is available, certain practical considerations influence the choice of materials. To provide a good gasket for an in situ threaded closure regard must be paid both to sealing performance and to the need to be able to unscrew the closure easily from the container. In general terms a gasket made of a soft, relatively resilient, material will give an excellent seal but will cause the closure to be difficult to unscrew. Conversely, a gasket made of a hard, relatively unresilient material will not give a very good seal, but will allow the closure to be unscrewed easily. It is necessary to strike a balance between the two requirements.

We have now found that this balance can more easily be struck if the dimensions of the peripheral portion of the gasket, in particular of the flat part (ii) and the corner part (iii), are modifed from those recommended in the above-described first embodiment of the invention. In general terms, the nature of the modification is to enlarge the corner part (iii) both in the radial direction and in the direction parallel to the skirt of the cap. To do this it is necessary to reduce the radial length of the step part (ii) somewhat. Too severe a reduction of the step part would reduce the resistance of the cap to cocking during the closing operation. The second embodiment of the invention is therefore connected with a delicate selection of dimensions which alters the balance between sealing performance of the gasket and unscrewability of the cap so as to permit relatively hard gasket materials to be used with better results, yet still mitigates or overcomes problems of cocking during the closing operation.

The second embodiment will be better understood by reference to FIG. 4 of the accompanying drawings which shows in section, taken through part of the radius, the peripheral portion of a gasket of the invention within a cap blank.

FIG. 4 has been labelled geometrically with the same reference letters and numerals as for FIGS. 2 and 3. Referring to the peripheral portion 2 of the gasket, the first part AB is as described with reference to FIGS. 2 and 3, except that its preferred radial length is 15 to 30 percent of the radial length AW of the whole peripheral portion AE.

The second step portion BC may be flat or have a slight upward slope so that the angle $\alpha$ may be from 0 to 25° usually 0° to 15° and preferably 5° to 10°. The radial length of the step portion BC will generally be at least 10 but less than 30 percent of the radial length AW of the whole peripheral portion AE, preferably 15–25%. This is distinguished from the range of 30–70% recommended for the first embodiment. The optimum height XY of the step portion above the level of the central panel 4 will depend on the resilience and toughness of the gasket material employed and may also depend on the nature of the neck of the bottle, as discussed further with reference to FIGS. 5 and 6.

The "corner part" CD will normally have a concave slope when viewed as in the drawing, but a planar or slightly convex slope might be appropriate for some purposes. The radial length of CD should be from 25 to 48% of AW. In a closure of internal diameter about 1 inch (25–30 mm.), CD is preferably concave with a radius of about 0.045 to 0.06 inch (1.1 to 1.5 mm.). The height of CD will vary according to precisely how much gasket material it is desirable to have pressed into the corner of the cap when the cap is closed onto the bottle. In general the distance DX will be from 55 to 65% of the total height DY of point D above the central panel (compared with 20 to 60% in the first embodiment).

The ratio of the radial length of corner portion CD to the step portion BC should be at least about 0.8:1. It could be made as high as, say, 4.7:1 depending on the precise combination of sealing, unscrewability and anticocking properties required. Towards the higher end of this range cocking problem may begin to re-appear, and the preferred range is about 0.8:1 to 1.7:1. Of course, if a softer gasket material was used the ratio could be as low as 0.6:1, e.g. in a cap of internal diameter about one inch (25–30 mm.) in which CD is concave with a radius of about 0.04 inch (1.02 mm.). However, the removal torque may then become rather high.

The portion DE is as described with reference to FIGS. 2 and 3.

All the corners at points A, B and C are preferably rounded slightly, for ease of moulding, but in principle they could be sharply defined.

The above-given dimensions have been found particularly suitable for gaskets made of mixtures of polyethylene and butyl rubber containing more than 50% and up to 70% polyethylene, by weight; such gaskets are defined in our British Pat. No. 1,112,025. They are also suitable for gaskets made of mixtures of polyethylene with a thermoplastic copolymer of styrene and butadiene as defined in our British Pat. No. 1,196,125. These mixtures are harder than 50% polyethylene/50% butyl rubber compositions and impart a lower removal torque to the cap. For example gasket No. 1 of the Table below has a removal torque, measured after 3 days, of about 20 inch-lb. (23.0 kg. cm.) when the gasketting material is 50% polyethylene/50% butyl rubber and about 12 inch-lb. (13.8 kg. cm.) when the gasketting material is 70% polyethylene/30% butyl rubber.

It is possible to reduce removal torque by including a slip additive in the gasket composition typically in a proportion of up to 1.5 weight percent based on the weight of the gasketting polymer. However such an additive is often difficult to mix with the gasketting polymer, especially if more than about 1 weight percent has to be added. An advantage of the second embodiment of the present invention is that satisfactory removal torques can be obtained without resource to adding large amounts of slip additive.

Table 2 gives the dimensions of one particular gasketted cap blank in accordance with FIG. 4 and, repeats for comparison the dimensions set out in Table 1 for a gasketted cap blank in accordance with FIG. 2.

TABLE 2

| | FIG. 2 | | FIG. 4 | |
|---|---|---|---|---|
| | inches | (mm.) | inches | (mm.) |
| External diameter of closure | 1.102 | (28.000) | 1.102 | (28.000) |
| Internal diameter of closure d | 1.092 | (27.737) | 1.092 | (27.737) |
| Distance x | 0.425 | (10.795) | 0.415 | (10.541) |
| Ratio x/d | 0.39 | | 0.38 | |
| Radial lengths | | | | |
| of AB | 0.0223 | (0.566) | 0.0323 | (0.820) |
| of BC | 0.0521 | (1.323) | 0.0315 | (0.800) |
| of CD | 0.0331 | (0.841) | 0.0537 | (1.364) |
| of DE | 0.0135 | (0.343) | 0.0135 | (0.343) |
| of AE (=AW) | 0.121 | (3.073) | 0.131 | (3.327) |
| Ratio of radial lengths of CD/BC | 0.64 | | 1.70 | |
| Heights | | | | |
| YX (central panel) | 0.006 | (0.152) | 0.006 | (0.152) |
| XY | 0.0416 | (1.057) | 0.0416 | (1.057) |
| DX | 0.0336 | (0.853) | 0.0545 | (1.384) |
| Radii of curvature | | | | |
| At A (concave) | None | | 0.10 | (2.54) |
| At B (convex) | 0.027* | (6.86) | 0.027* | (6.86) |
| of CD (concave) | 0.040 | (1.016) | 0.065 | (1.651) |
| Angles | (degrees) | | | |
| $\alpha$ | 10 | | 10 | |
| $\beta$ | 50 | | 36 | |

*The whole portion AB (except for the concave radius at A in FIG. 4) has a convex slope of this radius of curvature.

Considerable variation is possible from the dimensions given in Tables 1 and 2 but in general the overall weight of gasket material ("film weight") will be less than the 450 mg. frequency needed for spun-lined gaskets in this type of cap. A film weight as low as about 250 mg. can be attained by the present invention.

The method of closing the cap blank onto a container comprises placing the gasketted metal cap blank (which is of course made of thin metal, e.g. aluminium of thickness 0.008 to 0.012 inch [200–300 microns]) over the threaded neck of the container, pressing the cap blank down against the neck of the container, and whilst holding it so pressed, reducing the diameter of the skirt of the cap blank at a position above the threads on the neck of the container, so as to compress the gasket material between the top of the skirt of the cap blank and the side of the neck of the container, and forming threads in the skirt of the closure by deforming it at a position and in a configuration corresponding to the threads on the neck of the container. The reduction of diameter of the skirt may be effected by use of a closure head of suitable shape, as described in British Patent Specification No. 975,739. This operation will normally procede the operation of forming the threads.

The closures of the invention may be closed onto a variety of containers, but it is envisages that the invention will be of use mainly for caps closable onto glass bottles. The glass bottles may have necks of various types. One type common in the U.K. is shown in FIG. 5. The neck has a reinforcing ring 11 located below the threads 12. If the peripheral portion of the gasket is too thin the cap will be pressed too far onto the bottle, causing the head of the cap to hit the locking ring. This collision with the locking ring will damage the cap and the seal. If the cap is pressed onto the bottle slightly out of the correct vertical alignment, i.e. if there is cocking, the lower end of the cap may strike the reinforcing ring.

The flat step part of the peripheral portion helps to prevent this from happening. The invention is therefore of particular use in relation to containers having on the neck a ring located immediately below the threads which is of larger diameter than the internal diameter of the mouth of the cap blank.

FIG. 6 shows a "pilferproof" neck, the so-called "MCA finish", widely used in Germany, Belgium, Netherlands and Luxembourg. The reinforcing ring in FIG. 6 takes the form of a locking band 11 located below threads 12 is thicker, but of small diameter than the ring 11 in FIG. 5. A cap with a long skirt is employed, so that the skirt is closed over the locking band 11 and into the area 13 of narrower diameter below it. The cap is then pressed into the container neck in the area 13. A narrow band which is easily fracturable is provided in the skirt of the cap in the region corresponding to the locking band 11. It is then impossible to unscrew the cap from the neck without causing feature at the said narrow band.

The diameter *t* of the threads in FIG. 5 is typically 1.063 or 1.088 inches (26.00 or 26.65 mm.), the diameter *e* of the rim correspondingly 1.000 or 0.975 inch (25.4 or 24.8 mm.) and the height *h* from the rim of the neck to the top of the reinforcing ring about 0.58 inch (14.7 mm.). Typical dimensions for FIG. 6 are: $t = 27.65$ mm., $e$ 24.92 mm. and $h = 9.65$ mm.

The rim of the neck has a flat top 14 which at its circumference curves downwardly to meet side wall 15. The radially outermost edge of the flat top (flat area) of the rim is marked by F. When the rim contacts the gasket initially in the closing operation, places beyond F on the rim in the radially outward direction should not contact the gasket at places radially inward of B within the cap blank.

The gaskets may be formed within the caps by moulding them, using a punch. A quantity of gasketting material is deposited within the up-turned cap which, when appropriate, may be pre-heated. It will normally be necessary to heat the gasketting material to soften it. It is the moulded with the punch, which may optionally itself be heated. The methods of moulding well known to those skilled in the art of gasketting "crown" bottle caps have general applicability. Although moulding is very advantageous, the invention lies primarily in the configuration of the gasket. Therefore any method of producing this configuration is in principle acceptable, and the invention is not to be construed as limited by the process of making the gaskets.

The invention includes containers, especially bottles filled with beverages for human consumption, closed by caps of the invention. In the following Examples tests are reported showing the excellent seals which can be obtained. Percentages are by weight.

EXAMPLE 1

A cap blank of FIG. 2 containing a polyethylene/butyl rubber gasket and having the cap blank and gasket dimensions given in Table 1 and a gasket film weight of 259 mg. was closed by a reform operation onto glass bottles having the standard "continuous thread" finish shown in FIG. 4. The force of the closing head was 320 lb. (145 kg.) and the side-roller force on the skirt of the cap blank was 40 lb. (18.1 kg.). For comparison caps lined with 470 mg. of a spun-line polyvinyl chloride gasket were closed onto the same type of glass bottles under the same conditions.

No problems of "cocking" occurred.

Venting pressure tests showed that caps having both kinds of gasket had excellent resistance to the internal pressure of gases, such as are present in carbonated beverages, there being little difference between the two sets of results (see Table 3). Venting pressures were determined as follows. The caps were closed onto glass bottles with a hole cut in the bottom. The necks of the bottles were immersed in a water bath so that the cap was under water. The bottles were pressurised with compressed air introduced through the hole in the bottom at a rate of 10 p.s.i. (0.7 kg./sq. cm.) per 10 seconds, until bubbles appeared in the water indicating failure of the seal or the pressure reached 120 p.s.i. (8.4 kg./sq. cm.). Attainment of this pressure indicates a satisfactory seal.

Table 3

| venting pressures (six samples) | |
|---|---|
| Cap of present invention: | >120, 110, >120, >120 >120, >120 p.s.i. |
| Cap containing spun-line gasket: | >120, >120, 115, 115, >120, >120 p.s.i. |
| (110 p.s.i. = 7.7 kg./sq. cm; 115 p.s.i. = 8.1 kg./sq. cm; 120 p.s.i. = 8.4 kg./sq. cm.). | |

This Example shows that a far lower film weight is possible in the present invention than that used in a cap gasketted with a spun-line gasket. Part of the 45% decrease in film weight is attributable to the use of a material which is less done than polyvinyl chloride, the specific gravity of the polyethylene/butyl rubber gasket being 0.9 compared with 1.2 for the polyvinyl chloride one. However, polyethylene/butyl rubber mixture is not usuable in the spin-line process and it is a particular advantage of the invention that by providing a suitable configuration for a gasket which can be moulded, it is possible to use polyethylene/butyl rubber. Moreover, the decrease in film weight attributable to difference in density of the gasket materials is only 25% out of a total decrease of 45%.

EXAMPLE 2

Pellets of gasketting material were moulded into gaskets in a 28 mm. roll-on bottle cap blank of thin aluminium. Three different main types of gaskets were moulded, details as follows:

| Designation | Composition of gasketting material in weight % | Configuration of gasket |
|---|---|---|
| A | 70% polyethylene/30% butyl rubber | FIG. 2/Table 2 |
| B | 70% polyethylene/30% butyl rubber | FIG. 4/Table 2 |
| C | 50% polyethylene/50% thermoplastic styrene-butadiene copolymer "Cariflex TR 1102" | FIG. 4/Table 2 |
| D | Polyvinyl chloride plastisol | Spun-line (i.e. according to prior art formed by spinning the closure about an axis through its centre) |

Gaskets were moulded from compositions A, B and C containing no slip additive and various proportions of an oleamide slip additive.

Removal torques were determined after allowing the gaskets to age for one day. Some samples were subjected to venting pressure tests to determine the strength of the seal. The results show that all the gaskets imparted satisfactory removal torques, i.e. good unscrewability, to the caps, but gaskets A according to FIG. 2 did not give a satisfactory seal because of the hardness of the material choosen. On the other hand, an excellent seal and low removal torque were obtained from the gaskets B and fC. (It will be understood that the FIG. 2 gasket would have given a good seal if a softer material had been used for the gasket. A slip additive would then be useful to decrease the removal torque.)

Results are shown in Table 4 below. The removal torques were obtained as an average of 10 samples, except in the instances otherwise noted.

TABLE 4

| % slip additive | Removal torques after 1 day in inch lb. (kg. cm.) A | B | C | D |
|---|---|---|---|---|
| 0 | 10.5 (12.1) | 12.1 (13.9) | 10.5 (12.1) | 9.2+ (10.6) |
| 0.1 | 7.9 (9.1) | 8.4 (9.7) | 7.2 (8.3) | — |
| 0.2 | 7.9 (9.1) | 8.3 (9.6) | 5.8 (6.7) | — |
| 0.4 | 6.8 (7.8) | 7.4 (8.5) | 6.0 (6.9) | — |
| 0.7 | 5.4 (6.2) | 7.3 (8.4) | 4.9 (5.6) | — |
| 1.0 | 7.6 (8.8) | 8.7 (10.0) | 5.1 (5.9) | — |
| 1.5 | 4.4* (5.1) | 4.1 (4.7) | — | — |

*average of 9 samples
+ average of 6 samples

Venting pressure of 2 samples of A (containing 0.1 and 1.5% slip additive) were only 25 and 35 p.s.i. (1.75 and 2.45 kg./sq. cm.) respectively. Venting pressures were determined on 25 samples of B and C. Two samples of B and one of C containing no slip agent withstood pressures of 110, 112, and 120 p.s.i. (7.7, 7.8 and 8.4 kg./cm.$^2$) respectively and the other 22 withstood pressures of over 120 p.s.i. (over 8.4 kg./cm.$^2$).

In the following claims letters have been inserted in parenthesis in order to facilitate reference between claims and description and between one claim and another. They are not to be understood as in any way limiting the scope of the claims.

I claim:

1. A roll-on cap blank destined to closing and sealing a bottle, which comprises an end panel, a depending peripheral skirt and a liner affixed to said end panel, said liner having (a) a flat central panel occupying from 50 to 94% of the internal radius of the cap blank and (b) an adjoining peripheral portion occupying the remaining 6 to 50% of the radius, the configuration of the peripheral portion being as follows, namely; considering the cap blank in an up-turned position relative to that which the cap occupies on the container and considering the peripheral portion in a radially outward direction, it comprises consecutively:

i. a first part (AB) of relatively steep gradient upwards from the edge of the central panel which makes an angle ($\beta$) with the plane of the central panel of from 25 to 90° and which has a radial length of from 5 to 30% of the radial length (AW) of the whole peripheral portion (AE);

ii. an adjoining relatively flat step part (BC) of constant gradient which makes an angle ($\alpha$) with the plane of the central panel of from 0 to 25° and which has a radial length of from 10 to 70% of the radial length (AW) of the whole peripheral portion (AE);

iii. an adjoining corner part (CD) sloping upwardly, the height (DX) of which above the plane of the step part is from 20 to 65% of the height (DY) of the top of the corner part above the plane of the central panel, and iv. an adjoining final marginal part (DE) which extends to the skirt at a level not below that of the corner part and which has a radial length of from 2 to 15% of the radial length (AW) of the whole peripheral portion (AE).

2. The roll-on blank of claim 1 wherein:

i. the first part (AB) has a radial length of from 5 to 20% of the radial length (AW) of the whole peripheral portion (AE);

ii. the flat step part (BC) has a radial length of 40 to 60% of the radial length (AW) of the whole peripheral portion (AE) and the angle $\alpha$ and measures between 5 and 10°; and iii. the corner part (CD) has a height (DX) which is from 20 to 60% of the height (DY).

3. A roll-on blank as in claim 1 wherein:

i. the first part (AB) has a radial length of from 15 to 30% of the radial length (AW) of the whole peripheral portion (AE);

ii. the flat step part (BC) has a radial length of 10 to 30% of the radial length (AW) of the whole peripheral portion (AE) and the angle $\alpha$ and measures between 5 and 10°; and iii. the corner part (CD) has a radial length of from 25 to 48% of the radial length (AW) of the whole peripheral portion (AE) and a height (DX) which is 55 to 65% of the height (DY), with the ratio of the radial length of the corner part to the step part being from 0.8:1 to 1.7:1.

* * * * *